US008590955B2

(12) United States Patent
McEnaney

(10) Patent No.: US 8,590,955 B2
(45) **Date of Patent: *Nov. 26, 2013**

(54) RACK FOR CARRYING A HOSE

(76) Inventor: Edward McEnaney, Hicksville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/405,612

(22) Filed: Feb. 27, 2012

(65) Prior Publication Data

US 2012/0153651 A1 Jun. 21, 2012

Related U.S. Application Data

(63) Continuation of application No. 12/298,390, filed as application No. PCT/US2007/009528 on Apr. 19, 2007, now Pat. No. 8,231,160.

(60) Provisional application No. 60/795,001, filed on Apr. 25, 2006.

(51) Int. Cl.
*A62C 33/04* (2006.01)
*A45F 5/00* (2006.01)

(52) U.S. Cl.
USPC ..... 294/143; 294/159

(58) Field of Classification Search
USPC ..... 294/143, 159, 163, 137, 161, 165, 169, 294/157, 25, 15, 16, 167; 16/422, 430; 248/68.1, 65, 75; 211/87.01
See application file for complete search history.

(56) References Cited

U.S. PATENT DOCUMENTS

| | | | |
|---|---|---|---|
| 877,012 | A | 1/1908 | Sullivan |
| 2,404,531 | A | 7/1946 | Robertson |
| 3,526,934 | A | 9/1970 | Owen, Sr. |
| 3,892,343 | A | 7/1975 | Warner |
| 4,030,540 | A | 6/1977 | Roma |
| 4,799,641 | A | 1/1989 | Koreski |
| 4,890,731 | A | 1/1990 | Mroz |
| 4,905,940 | A | 3/1990 | Luka |
| 5,060,810 | A | 10/1991 | Jones |
| D402,468 | S | 12/1998 | Killins |
| 6,032,999 | A | 3/2000 | York et al. |
| 6,726,166 | B2 | 4/2004 | Goodman |
| 6,986,538 | B1 | 1/2006 | Ecker |

OTHER PUBLICATIONS

International Search Report corresponding to International Application No. PCT/US07/09528; completed on Aug. 26, 2008; mailed on Sep. 25, 2008; 3 pages.

*Primary Examiner* — Paul T Chin
(74) *Attorney, Agent, or Firm* — Carter, DeLuca, Farrell & Schmidt, LLP

(57) ABSTRACT

Disclosed is a device for carrying a hose or other tubular member. The device includes a first base member releasably connected to a second base member. The first and second base members operate to form a plurality of openings sized to receive a length of hose or other tubular member. The plurality of openings may be configured to permit charging of the hose without removing the hose from therein. The device may include a locking mechanism for selectively securing the first base member to the second base member. The locking mechanism may define a handle for supporting the device. The locking mechanism may further include a handle release for selectively unlocking the locking mechanism.

3 Claims, 24 Drawing Sheets

RACK FOR CARRYING A HOSE

CROSS REFERENCE TO RELATED APPLICATION

This application is a continuation application claiming the benefit of and priority to U.S. patent application Ser. No. 12/298,390, filed on Oct. 24, 2008 (now U.S. Pat. No. 8,231,160), which is a U.S. National Stage application that claims the benefit of and priority, under 35 U.S.C. §371, to International Application No. PCT/US2007/009528, filed on Apr. 19, 2007, which claims the benefit of and priority to U.S. Provisional Application Serial No. 60/795,001, filed on Apr. 25, 2006, the entire contents of which are hereby incorporated by reference.

BACKGROUND

1. Technical Field

The present disclosure relates generally to devices for supporting a hose or the like, and more particularly, to a device capable of supporting a charged or uncharged fire hose, or the like.

2. Background of Related Art

Fire hoses are important tools used by fire fighters when extinguishing fires. Fires are rarely, if ever, conveniently located near a ready supply of water. Water may be supplied by a nearby hydrant or may be transported to the fire by a tanker truck. In either event, one or more fire hoses may be required to convey the water from its source to the fire. Fire hoses vary in length and may be as long as 50-100 feet. Fire hoses generally consist of an inner rubber tube, a fabric outer sheath encasing and protecting the inner rubber tube and a set of threaded connectors for coupling lengths of fire hose together and/or for attaching a nozzle. The size and composition of fire hoses cause them to be quite heavy and awkward to support and carry.

Conventional methods for carrying a fire hose require the hose to be empty while the fire hose is being stored or supported. Generally, a stored or carried fire hose is wound tightly or folded onto itself. The resulting compacted fire hose saves space and makes the long lengths of fire hose more manageable. Typically, the fire hose cannot be charged until the fire hose has been removed from the carrying device. When a fire hose is charged, or filled with water, the relatively flat fire hose, when uncharged, expands, causing the fire hose to stiffen and straighten out. Unfortunately, with conventional carrying methods, the wound or folded fire hoses must be removed from their support and/or unwound before the fire hose may be charged. Therefore, it would be beneficial to have a device or rack for carrying a fire hose that permits the filling of the fire hose without removing the fire hose from the carrying device.

SUMMARY

A rack for carrying a tubular body, preferably a fire hose, is disclosed. The rack includes a first base member and a second base member. The second base member may be securely attached to the first base. The first and second base members cooperate to form a plurality of recesses for receiving a hose when the two base members are attached one another. The rack may further include a locking mechanism for selectively securing the first base member with respect to the second base member. The locking mechanism may include a handle.

In an alternate embodiment the first and second base members may form recesses therebetween for receiving at least one biscuit. The at least one biscuit may prevent lateral separation of the first and second body members relative to one another.

The first and second base members may be hingedly secured to one another. One of the first or second base members may include a tongue configured to be lockingly received with a groove formed in the other of the first or second base members.

The handle of the carrying rack may be configured to be rotatably received by a locking pin. The locking pin may include a notch for selectively engaging the handle.

In another embodiment, a carrying rack for supporting a charged fire hose is disclosed. The rack includes a first body member, a second body member, a hinge connecting the first body member to the second body member, a locking mechanism for selectively locking the first body member to the second body member. The first and second body members define recesses configured for receiving a charged fire hose. The locking mechanism may include a handle for supporting the carrying rack. The hinge may be a living hinge. The first and second body member are injection molded.

Further disclosed is method of supporting a hose. The method includes the steps of providing a carrying rack having a first base member, a second base member securely attachable to the first base member, wherein the first and second base members cooperate to form a plurality of recesses for receiving a hose when the first and second base members are attached one another; and a locking mechanism for selectively securing the first base member with respect to the second base member; placing a hose within the recesses formed within the first base member; and locking the second base member to the first base member such that the hose is retained therein.

The locking mechanism of the carrying rack may form a handle. The method of supporting a hose may further include the step of supporting the carrying rack by the handle.

BRIEF DESCRIPTION OF THE DRAWINGS

The foregoing summary, as well as the following detailed description will be better understood when read in conjunction with the appended figures. For the purpose of illustrating the present disclosure, a preferred embodiment and alternate embodiments are shown. It is understood, however, that the present disclosure is not limited to the precise arrangement and instrumentalities shown.

DETAILED DESCRIPTION OF THE DRAWINGS

Figure 1:
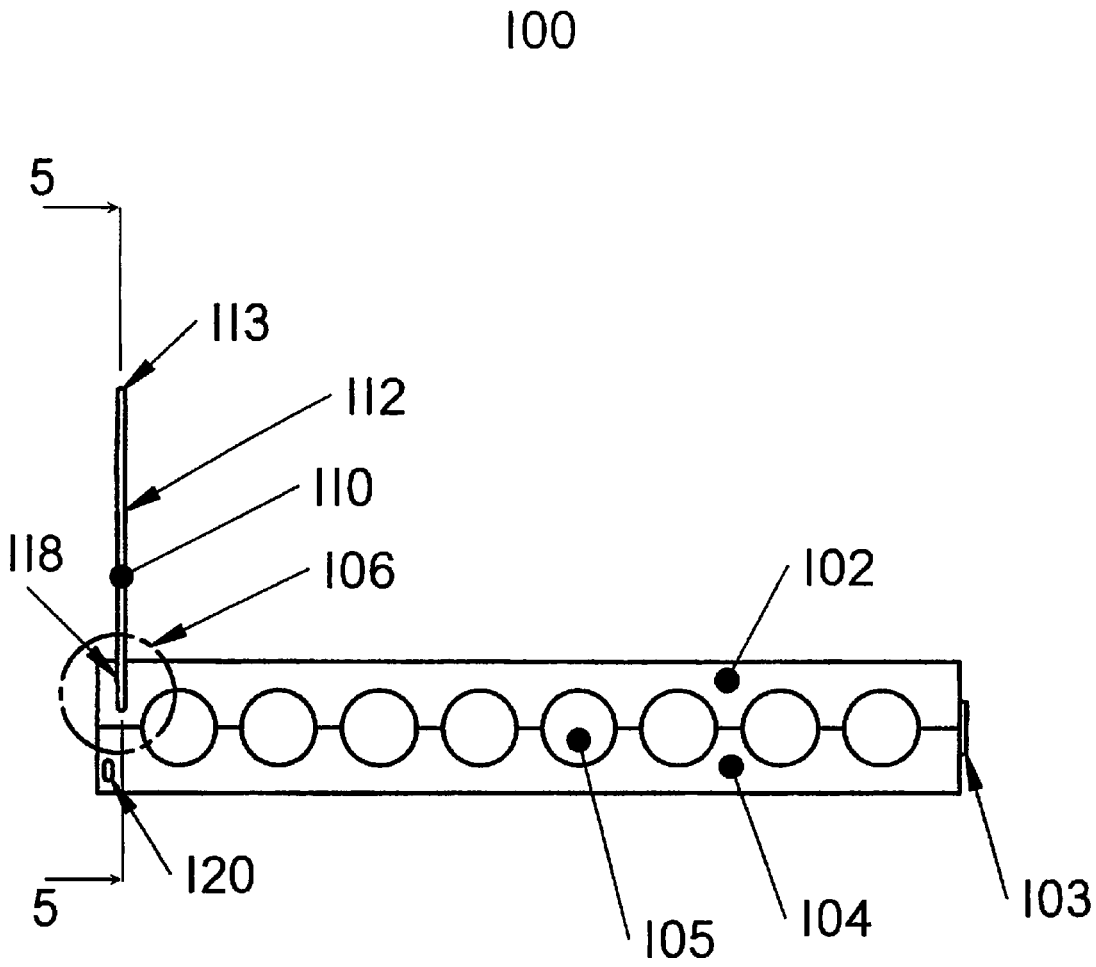
FIG. 1 is a right side view of a carrying rack constructed in accordance with an embodiment of the present disclosure.
Figure 2:
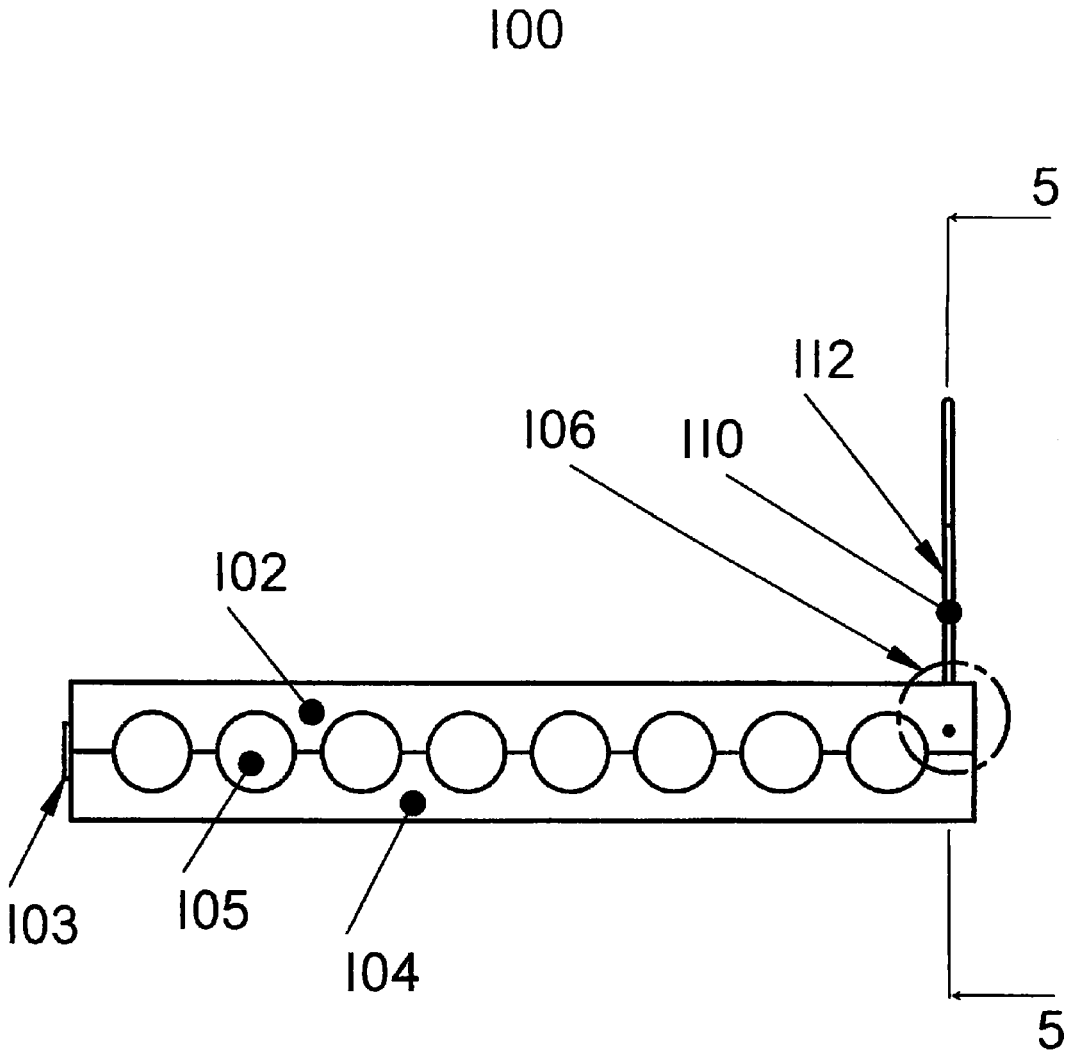
FIG. 2 is a left side view of the carrying rack of FIG. 1.
Figure 3:
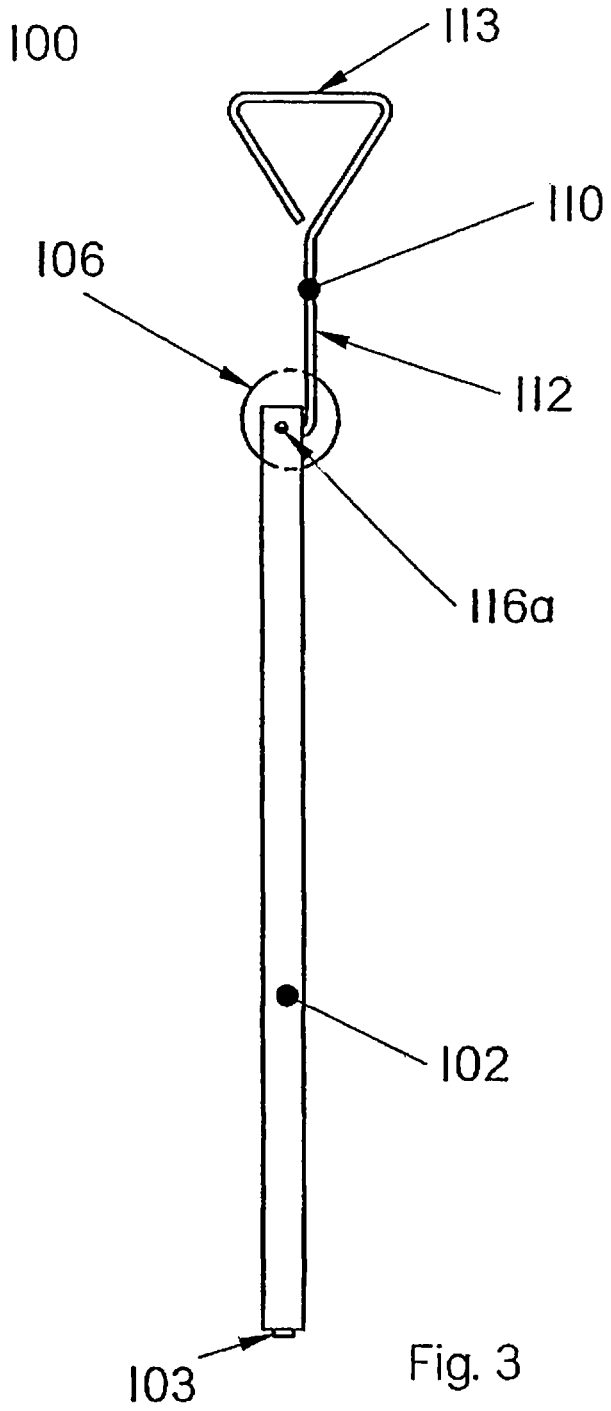
FIG. 3 is a top view of the carrying rack of FIGS. 1 and 2.
Figure 4:
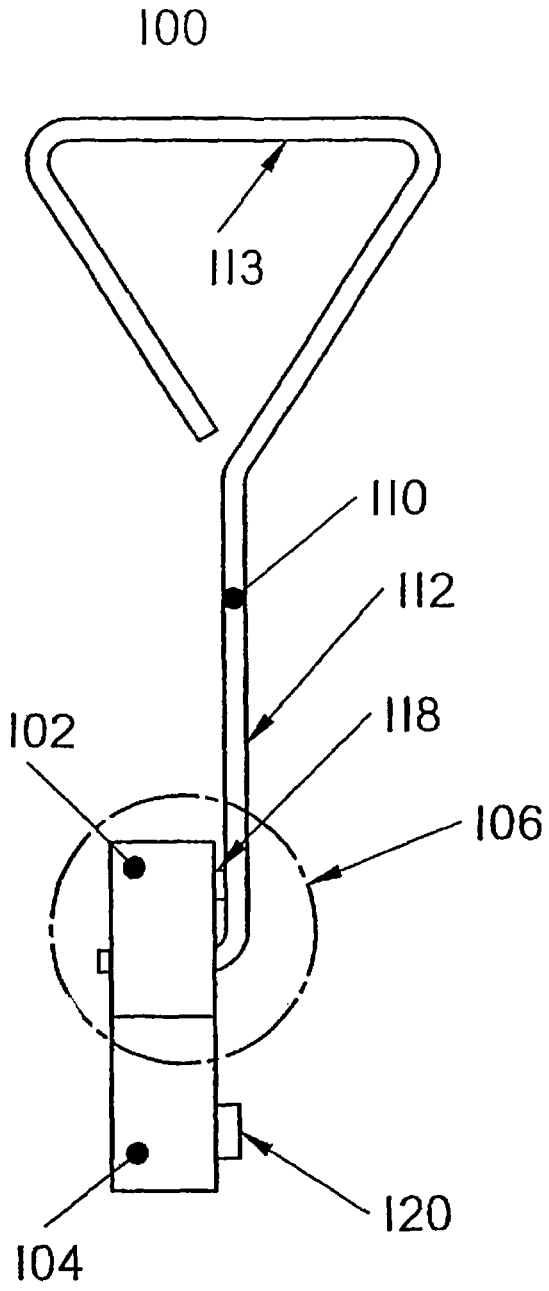
FIG. 4 is a front view of the carrying rack of FIGS. 1-3.

Preferred embodiments of the carrying rack and methods in accordance with the present disclosure will now be described in detail with reference to the drawing figures wherein like reference numerals identify similar or identical structural elements.

Referring to FIGS. 1-4, an illustrative embodiment of the presently disclosed carrying rack is illustrated therein and generally designated as carrying rack 100. Carrying rack 100 includes a first base member 102, a second base member 104 hingedly attached to first base member 102, and a locking mechanism 106 for releasably securing first base member 102 with second base member 104.

As seen in FIGS. 1-4, first and second base members 102, 104 are configured to form a plurality of openings 105 when first base member 102 and second base member 104 are approximated toward one another. Openings 105 are sized and dimensioned to receive a charged or uncharged fire hose (not explicitly shown). Unlike a fire hose that is empty or uncharged, and therefore takes on a flattened cross-section, a charged fire hose is full of water and expands to its maximum diameter. Thus, openings 105 may appear larger than necessary when supporting an empty fire hose. Openings 105 may have rounded or radiused edges to reduce friction between the outer surface of the fire hose and base members 102, 104. While openings 105 are shown as having a round profile, it is envisioned and within the scope of the present disclosure for openings 105 to have any suitable shaped profile, including and not limited to ovular, rectangular, triangular, etc.

While openings 105 formed in base members 102, 104 are dimensioned to receive a fire hose, it is envisioned that the invention of the present disclosure can be adapted to support and carry hoses of all diameters and thicknesses. It is further envisioned that the openings for receiving a fire hose may be formed entirely in either the first or second base members 102,104 as well as between the two members 102, 104 in any configuration. Carrying rack 100 may have any number of openings 105. The number of openings 105 formed by carrying rack 100 may correspond to the length of fire hose being supported.

Carrying rack 100 may be constructed from any number of rigid materials. Preferably, first and second base members 102, 104 are constructed of hard plastic or polymer, however, wood and metal (i.e., stainless steel) carry racks are also envisioned.

First and second base members 102, 104 are hingedly attached to one another by hinge 103. Hinge 103 is positioned on corresponding adjacent ends of first and second base members 102, 104 and operates such that opposing adjacent ends of first and second base members 102, 104 may be articulatably separated. Hinge 103 may be constructed of metal, plastic or the like. Hinge 103 may be of any conventional configuration and may be attached to first and second base members 102, 104 by any suitable known means, including with mechanical fasteners, adhesives, welding and the like.

Figure 13:
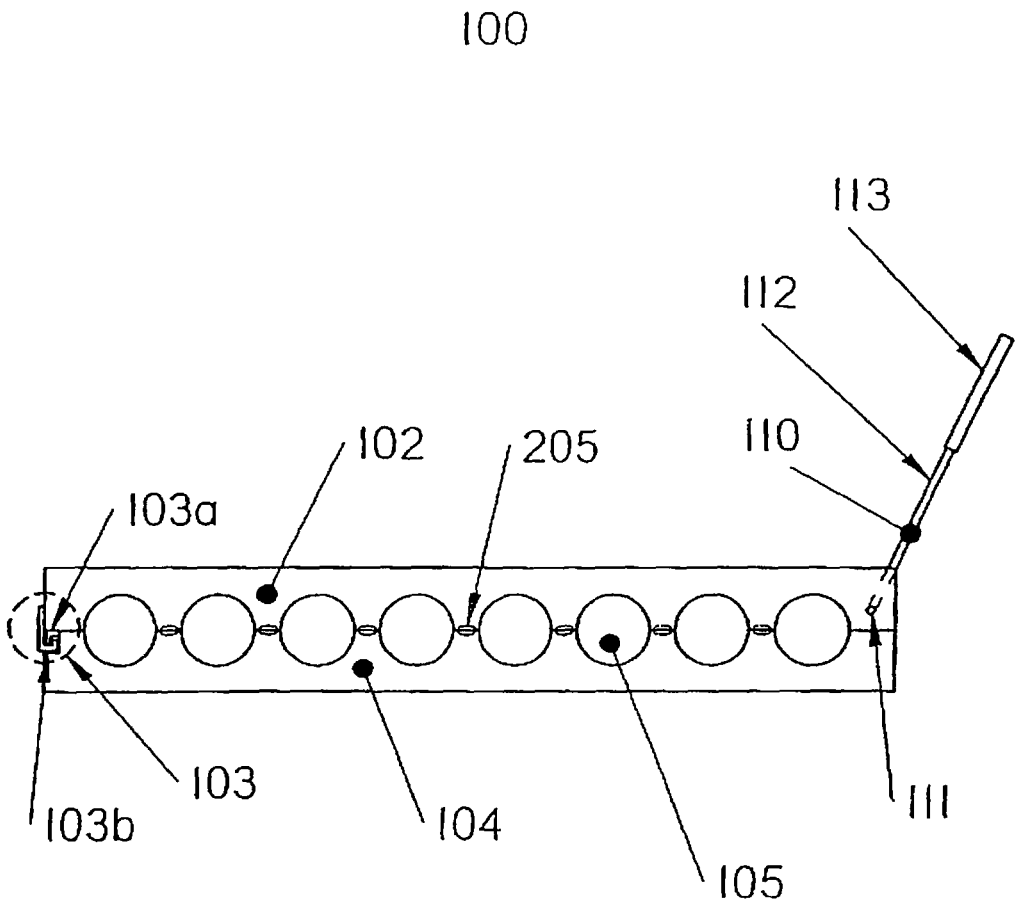
FIG. 13 is a side view of the carrying rack of FIGS. 1-4 illustrating an alternate embodiment in accordance with the present disclosure.
Figure 14:
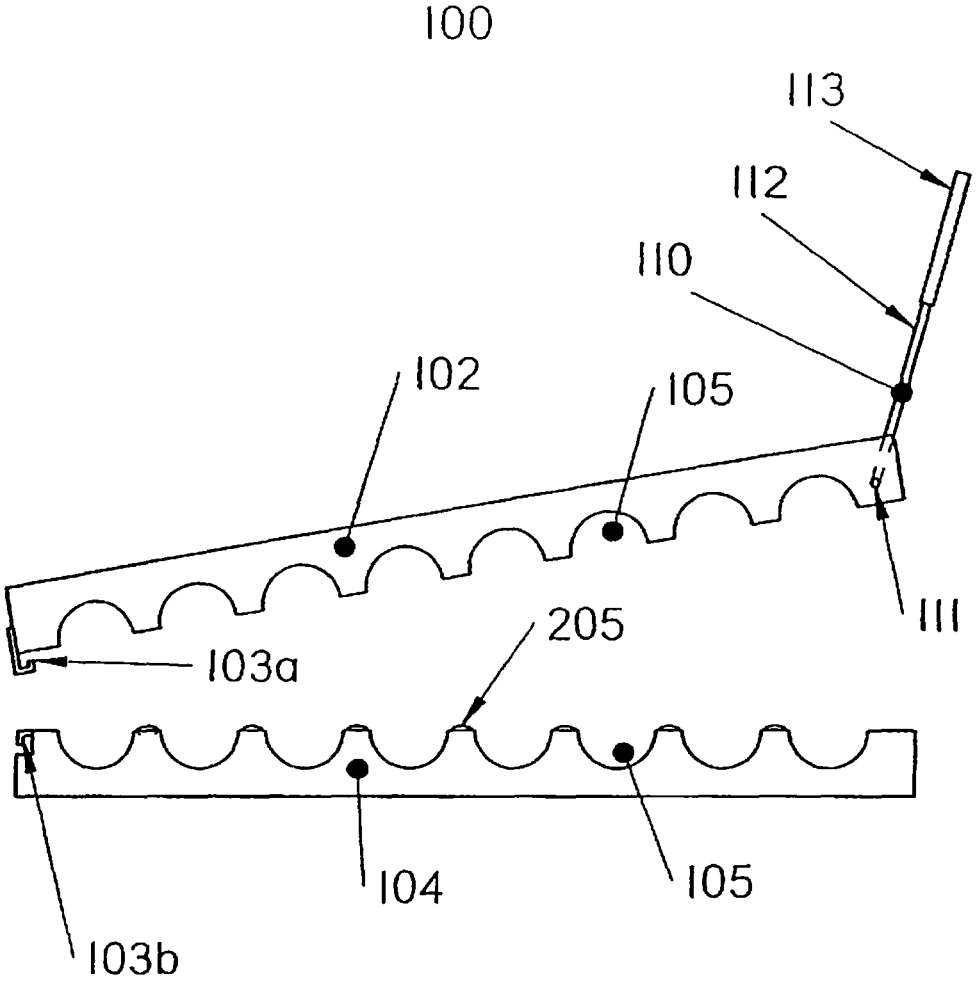
FIG. 14 is a side view of the carrying rack of FIG. 13 shown in an open and separated condition.

In an alternate embodiment of the present disclosure hinge 103 connecting the first and second base members may be a living hinge that is constructed as an integral part of the first and/or second base members 102,104. Hinge 103 may further include a pin or pins for securing the first base member 102 to the second base member 014. Hinge 103 may also be of a break-away, or readily separable, design whereby a supported fire hose may be more easily removed therefrom (see FIG. 13-14). As seen in FIGS. 13 and 14, break-away hinge 103 includes a first hinge member 103*a* securely mounted to first base member 102 and second hinge member 103*b* securely mounted to second base member 104. In an alternate embodiment, break-away hinge members 103*a*, 103*b* may be integrally formed with first and second base members 102,104, respectively. First hinge member 103*a* is configured to releasably engage second hinge member 103*b*.

Figure 5:
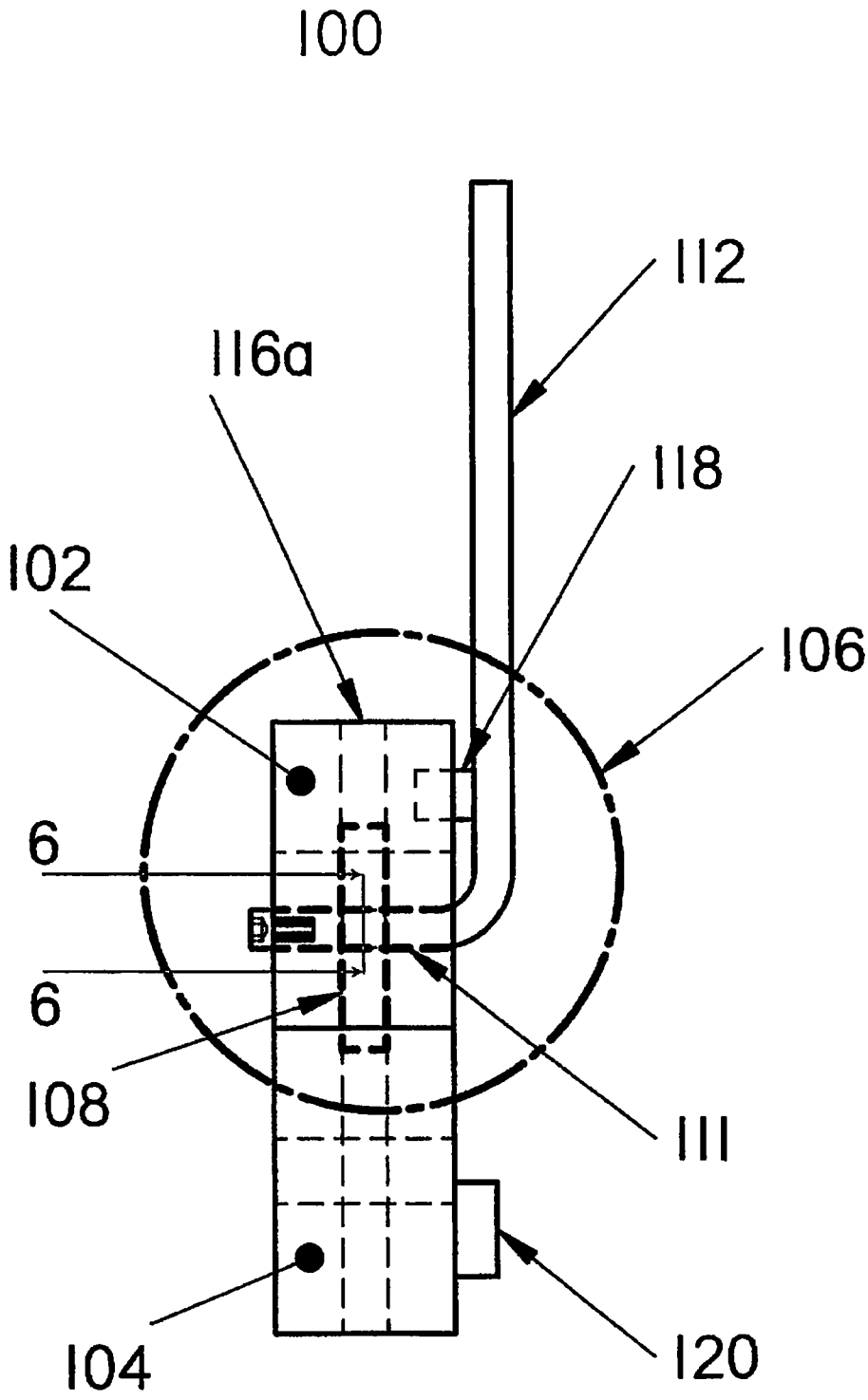
FIG. 5 is an enlarged cross-sectional view of the locking mechanism of the carrying rack of FIGS. 1-4, as taken along line 5-5 of FIGS. 1 and 2.
Figure 6:
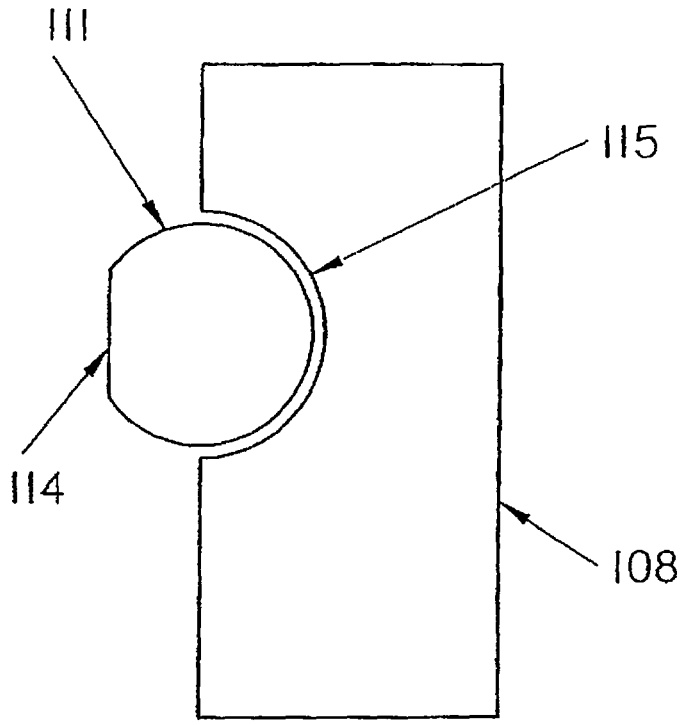
FIG. 6 is an enlarge cross-sectional view of the locking mechanism of FIG. 5 taken along line 6-6 of FIG. 5.

Carrying rack 100 includes locking mechanism 106 operably connected to first and second base members 102, 104 for releasably securing first and second base members 102, 104 to one another. As seen in FIGS. 5 and 6, locking mechanism 106 includes locking pin 108 and locking bar 110. Locking bar 110 forms an L-shaped member having a base 111 and an elongate body 112. Elongate body 112 terminates in handle 113 (See FIGS. 1-4). Handle 113 may be of any size and configuration, and is adaptable to suit various preferences and applications.

Base 111 of locking bar 110 is pivotally mounted to first base member 102 of carrying rack 100. Base 111 forms a cylindrical shaft having a cut-out or notch 114 (see FIG. 6) located near the mid-point of base 111. First base member 102 includes a recess 116 perpendicularly aligned with mounted base 111 of locking bar 110. Locking pin 108 is securely affixed to second base member 104 and is positioned to be received within recess 116 of first base member 102. Locking pin 108 includes a corresponding cut-out or notch 115 (see FIG. 6) configured for cooperative engagement with notch 114 of base 111. Recess 116 may extend completely through first base member 102 to form clean out hole 116*a*. Clean out hole 116*a* may be used to remove any debris that may accumulate in recess 116 preventing locking pin 108 from being completely received within recess 116.

As seen in FIG. 6, when notch 114 of base 111 is oriented away from cut-out 115 of locking pin 108, locking pin 108 is secured in position and prevented from moving, thereby maintaining first and second base members 103, 104 clamped together. As is understood, in operation, when notch 114 of base 111 is oriented toward cut-out 115 of locking pin 108, locking pin 108 is free to be pulled out of recess 116 of first base member 102 and thus allow first and second base members 102, 104 to be separated. In operation, rotation of base 111 about axis "Y", as a result of the movement of elongate body 112, results in the alignment and un-alignment of notch 114 of base 111 with cut-out 115 of locking pin 108.

Locking mechanism 106 further includes a handle release 118 and a handle stop 120. Handle release 118 is positioned on and extends from first base member 102. Handle release 118 is configured to retain handle 113 in a predetermined alignment. Handle release 118 further prevents the premature or unintentional unlocking of locking mechanism 106, and thus the separation of first and second base members 102, 104. Handle stop 120 is positioned on and extends from second base member 104 and is configured to prevent 360° rotation of handle 113 and/or elongate body 112. Handle release 118 and handle stop 120 may be constructed of metal, plastic, or the like.

Figure 7:
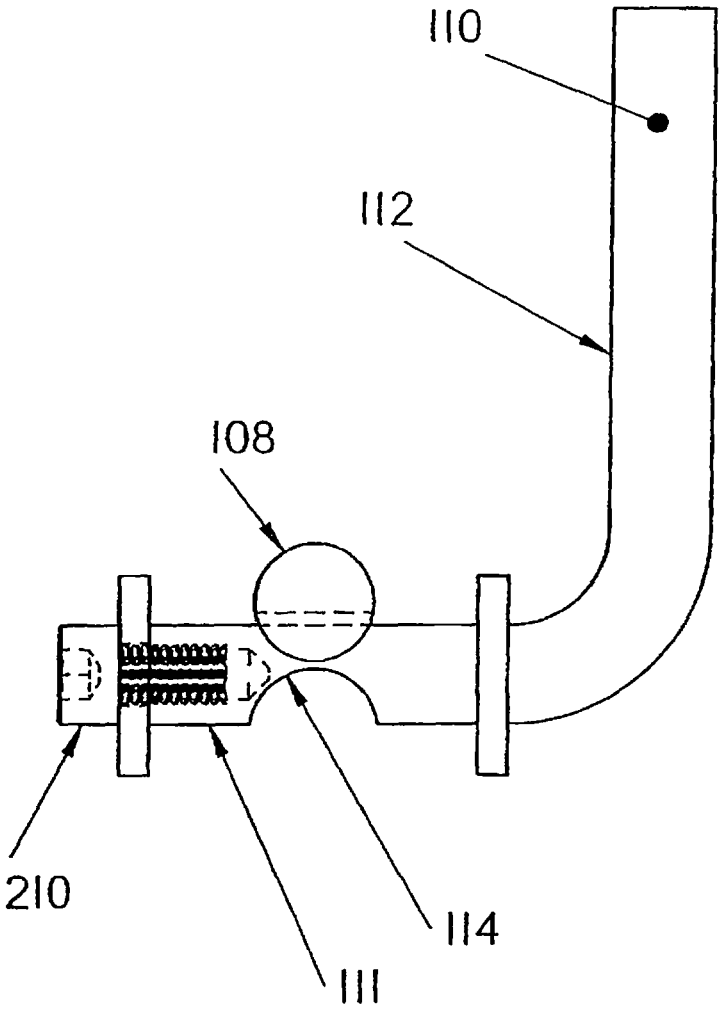
FIG. 7 is a cross-sectional view of the locking mechanism of FIGS. 5 and 6 taken along line 5-5 of FIGS. 1 and 2.
Figure 8:
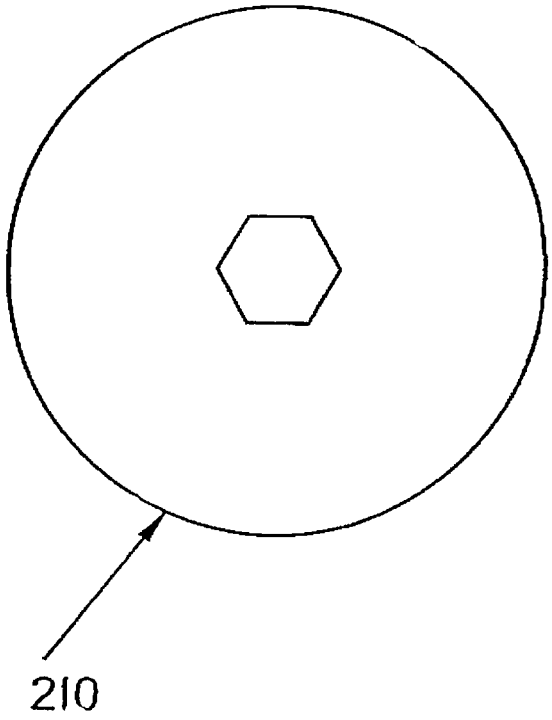
FIG. 8 is an end view of the locking mechanism of FIG. 7.

By way of example only, base 111 of locking bar 110 may have a threaded end (FIG. 7) for receiving a fastener for securing locking bar 110 to first base member 102. In this alternate embodiment, locking bar 110 may be secured to first base member 102 with a screw 210 having an allen key configuration (FIG. 8). All other fastening means have been contemplated by this disclosure for pivotally securing locking bar 110 to first base member 102. It is further envisioned that base 111 may be configured such that first base member 102 may be molded or formed about base 111, whereby base 110 will become an integral part of first base member 102. It is further envisioned that locking pin 108 may be integrally formed with second base member 104.

Figure 9:
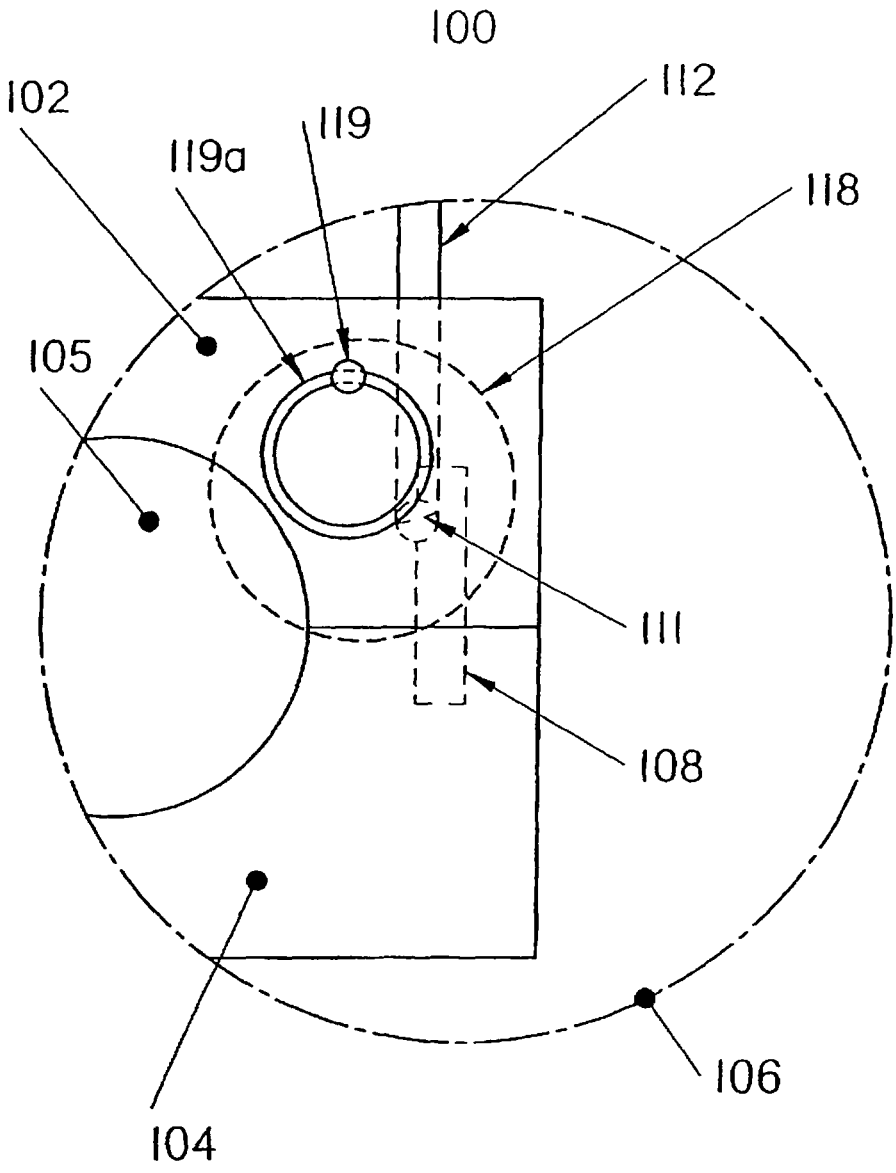
FIG. 9 is a left side view of an alternate embodiment of a locking mechanism for the carrying rack of FIGS. 1-4.
Figure 10:
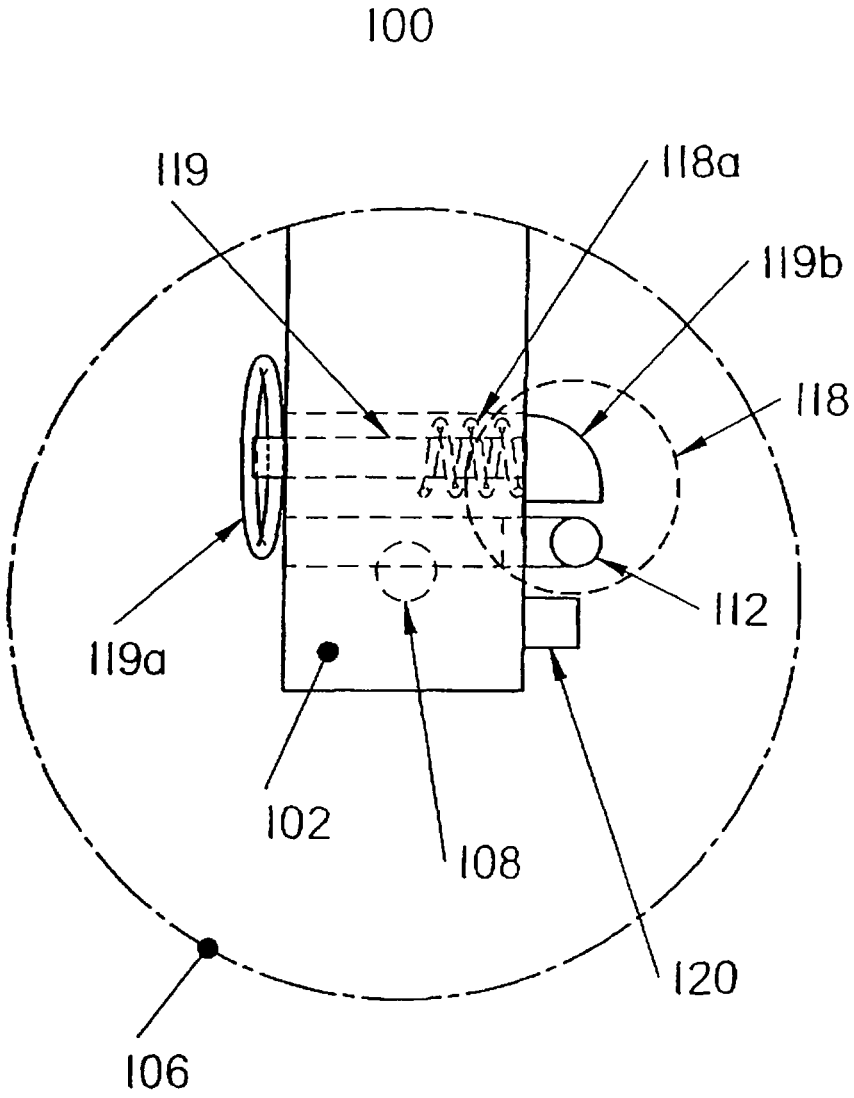
FIG. 10 is a top view of the locking mechanism of FIG. 9.
Figure 11:
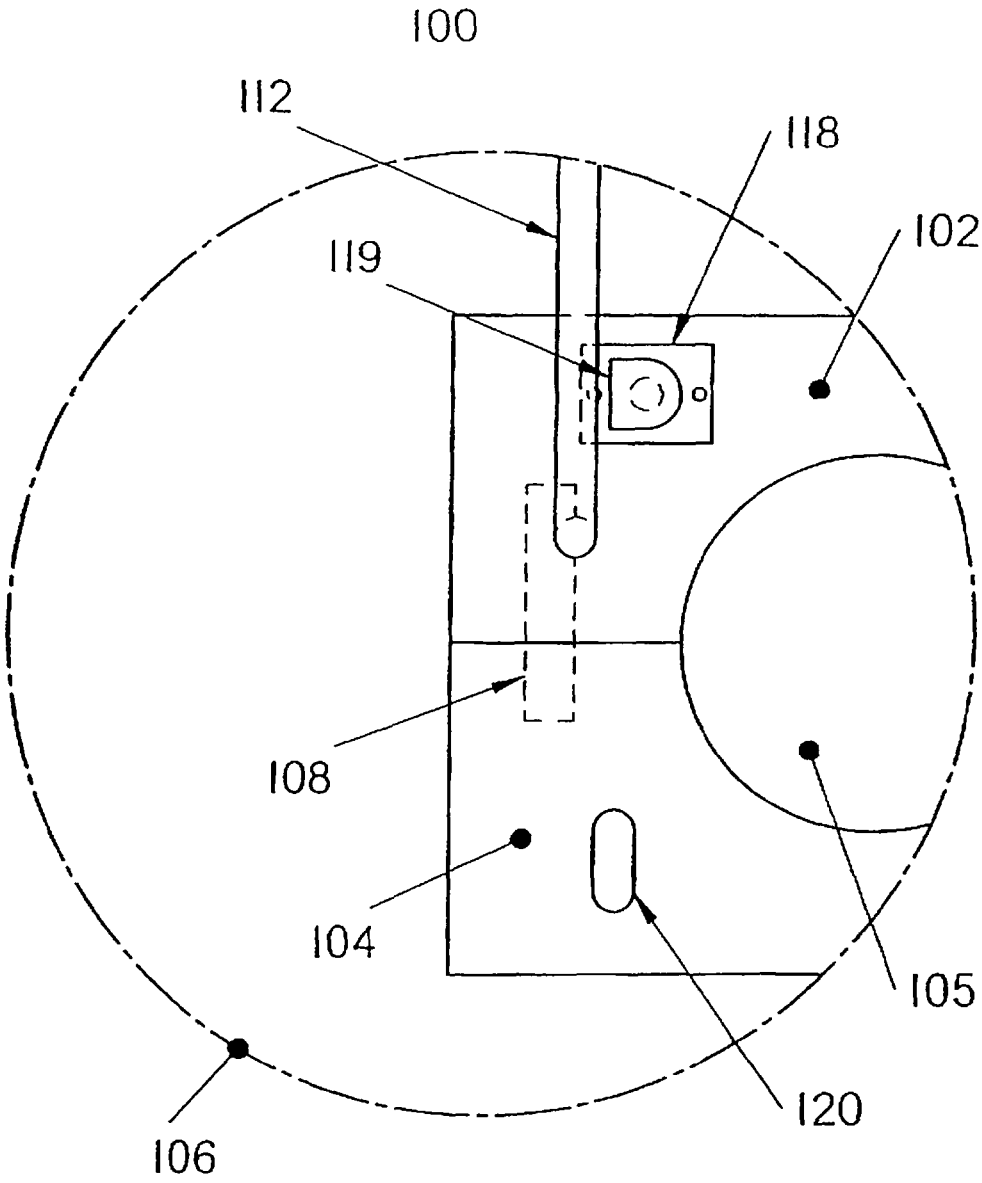
FIG. 11 is a right side view of the locking mechanism of FIGS. 10 and 11.

Referring now to FIGS. 9-11, in an alternate embodiment, handle release 118 may include a release pin 119 biasedly attached to first base member 102 by spring 118*a*. Release pin 119 includes ring or other grasping member 119*a* for securely grasping release pin 119. Release pin 119 is configured such that in a normal, unretracted position elongated body 112 is restricted from passing release pin 119, and thereby unlocking first base member 102 from second base member 104. When ring 119*a* is pulled against the bias spring 118*a*, release pin 119 is retracted and, elongated body 112 is permitted to pass. Once ring 119*a* is released, spring 118*a* returns release pin 119 to an unretracted position.

Release pin 119 is further configured such that elongated body 112 is permitted to pass beyond release pin 119 without retracting release pin 119 using ring 119*a*. In particular, a distal surface 119*b* of release pin 119 is angled such that as elongate body 112 is moved in a direction toward and beyond, angled distal surface 119*b*, elongate body 112 cams against angled distal surface 119*b* causing release pin 119 to retract against the bias of spring 118*c* and allow elongate body 112 to move beyond release pin 119 to a locked position.

Figure 12:
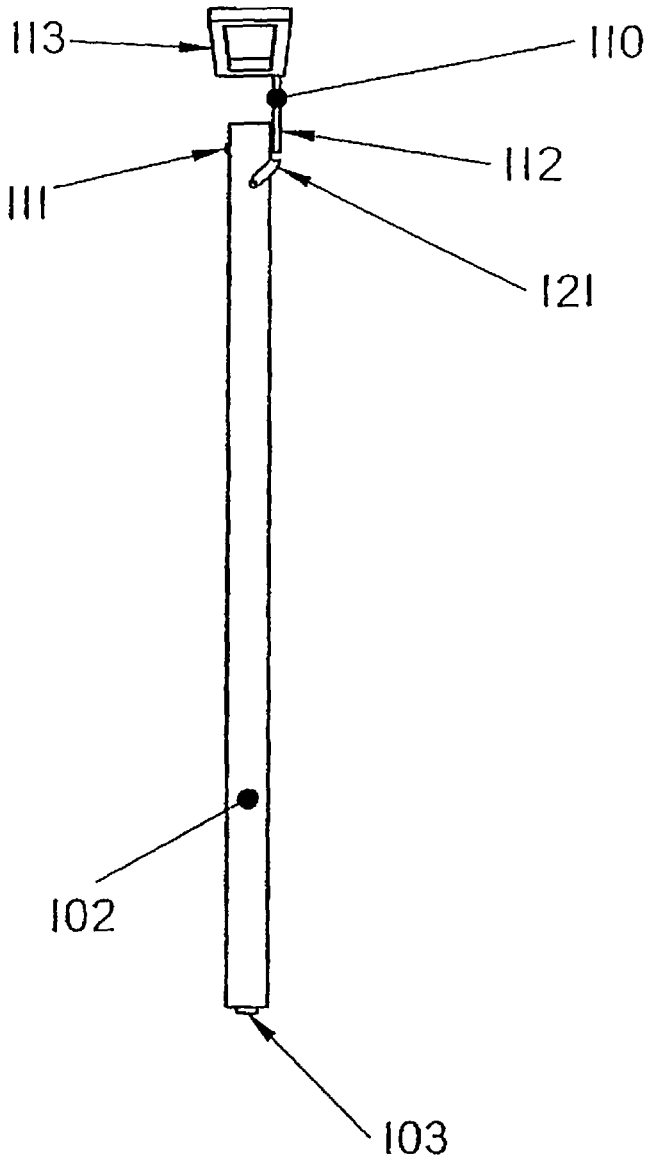
FIG. 12 is another alternate embodiment of a locking mechanism for the carrying rack of FIGS. 1-4.

Referring now to FIG. 12, in yet another embodiment of the present invention, handle release 118 is in the form of a moveable clip, tab or finger 121 selectively supported on first base member 102 and functions to prevent elongate member 112 from passing clip 121, and thereby unlocking first and second base members 102,104. Clip 121 may be integrally formed with first base member 102 or may be fixedly attached to the top surface of first base member 102. Similar to release pin 119, clip 121 is configured to be retracted or deflected, such that elongate member 112 is permitted to pass thereby. Clip 121 is further configured such that elongate member 112 is permitted to return past clip 121 without manually retracting clip 121.

Referring now to FIGS. 13 and 14, in an alternate embodiment of the present disclosure, first and second base members 102, 104 of carrying rack 100 may be configured to receive biscuits 205 between openings 105 formed in first and second base members 102, 104. First and second base members 102, 104 may be configured such that when biscuits 105 are positioned between openings 105, biscuits 205 prevent lateral movement or separation of first and/or second base members 102, 104 from one another.

Figure 15:
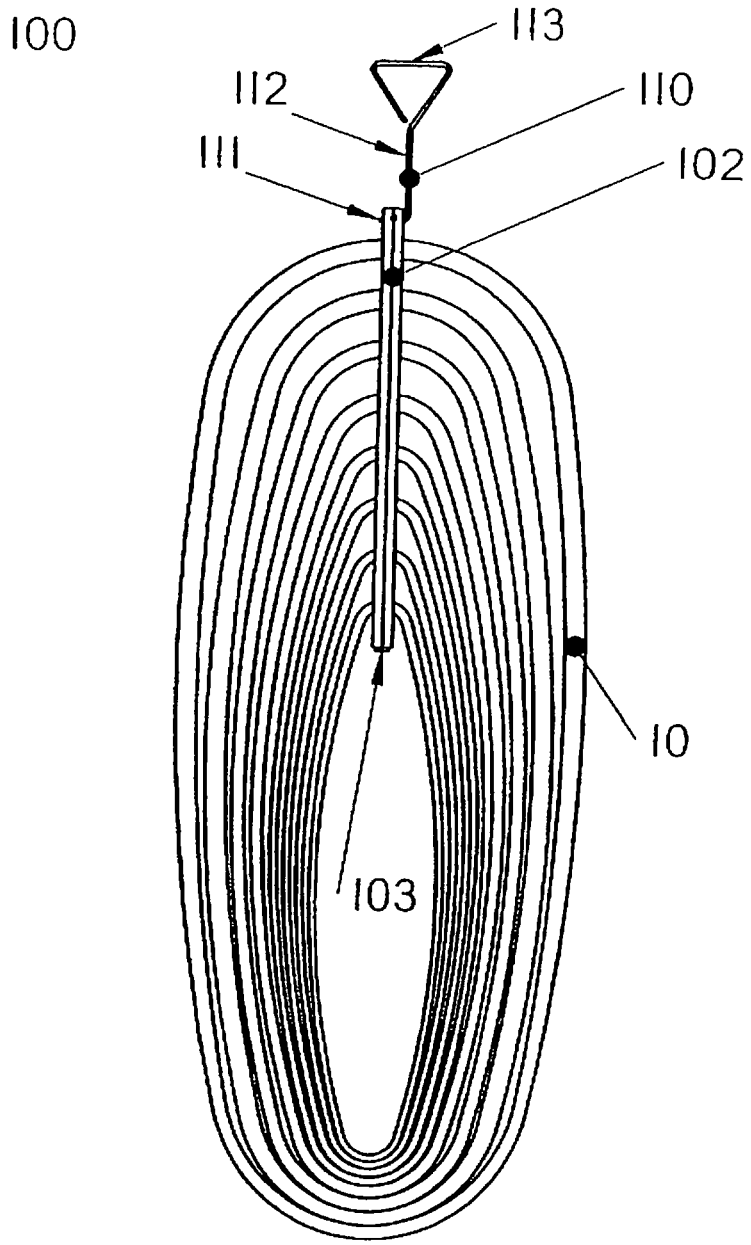
FIG. 15 is a plan view of the carrying rack of FIGS. 1-4 supporting an empty or uncharged fire hose.
Figure 16:
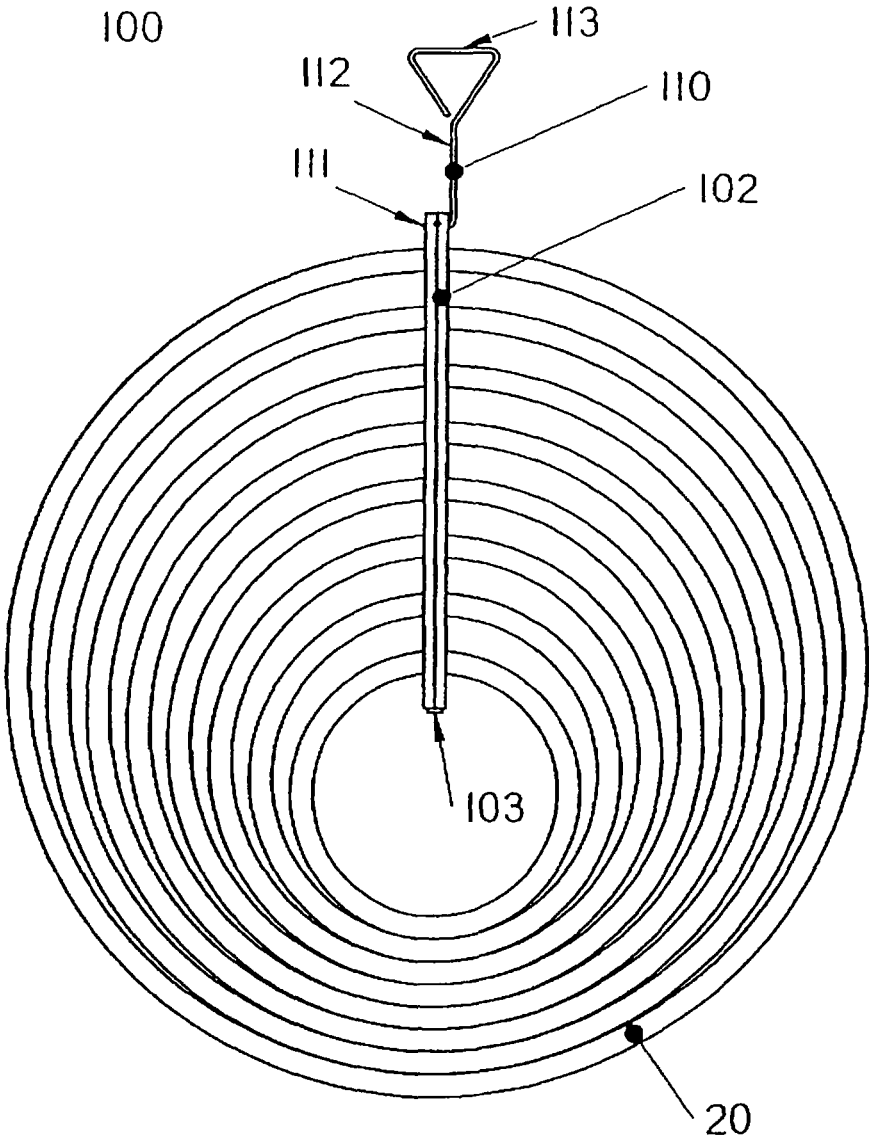
FIG. 16 is a plan view of the carrying rack of FIG. 9 shown supporting a full or charged fire hose.
Figure 17:
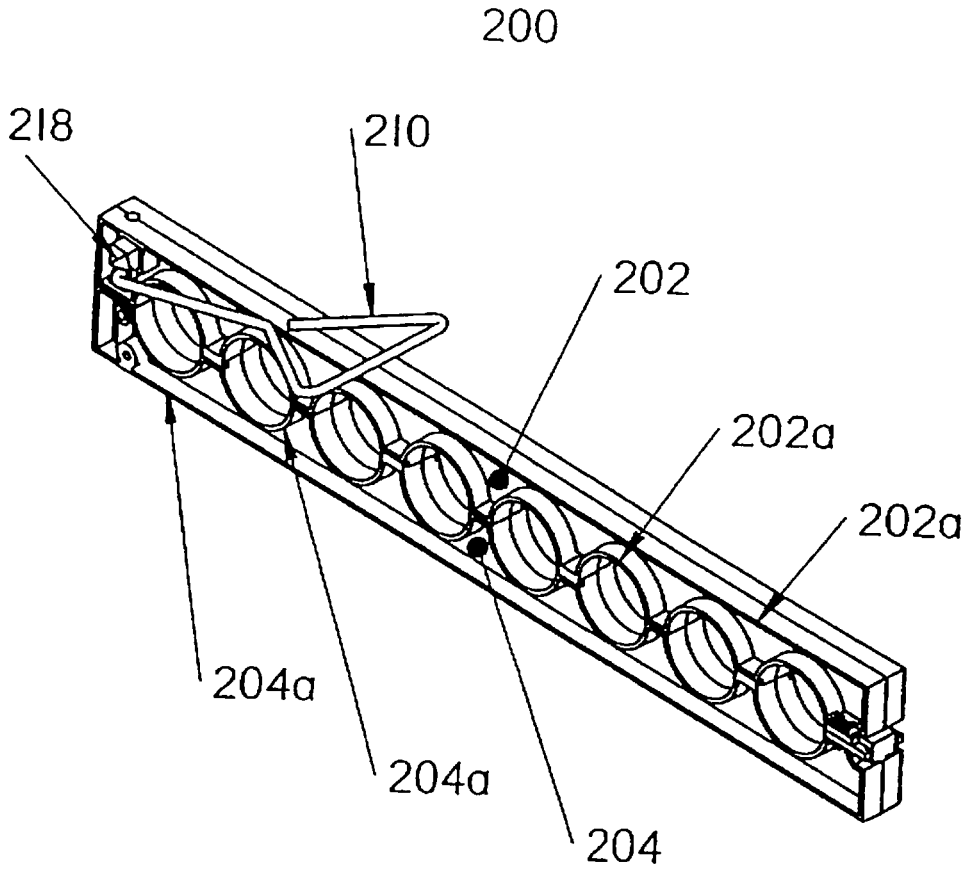
FIG. 17 is a perspective side view of another embodiment of a carrying rack in accordance with the present disclosure.
Figure 18:
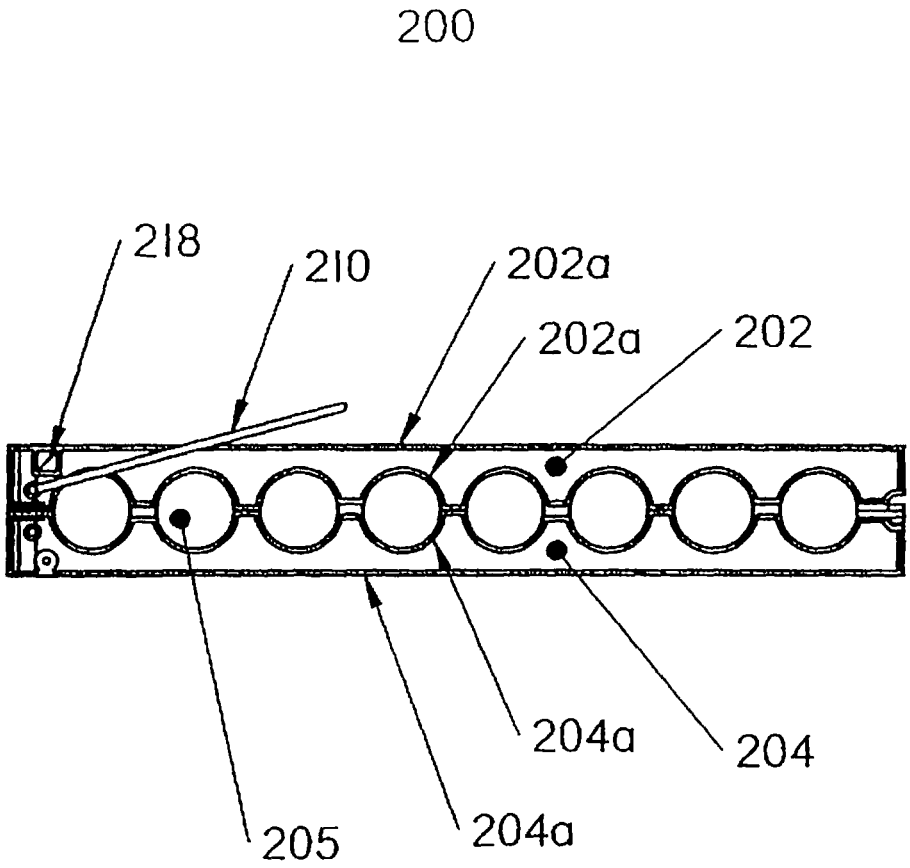
FIG. 18 is a side view of the carrying rack of FIG. 17.
Figure 19:
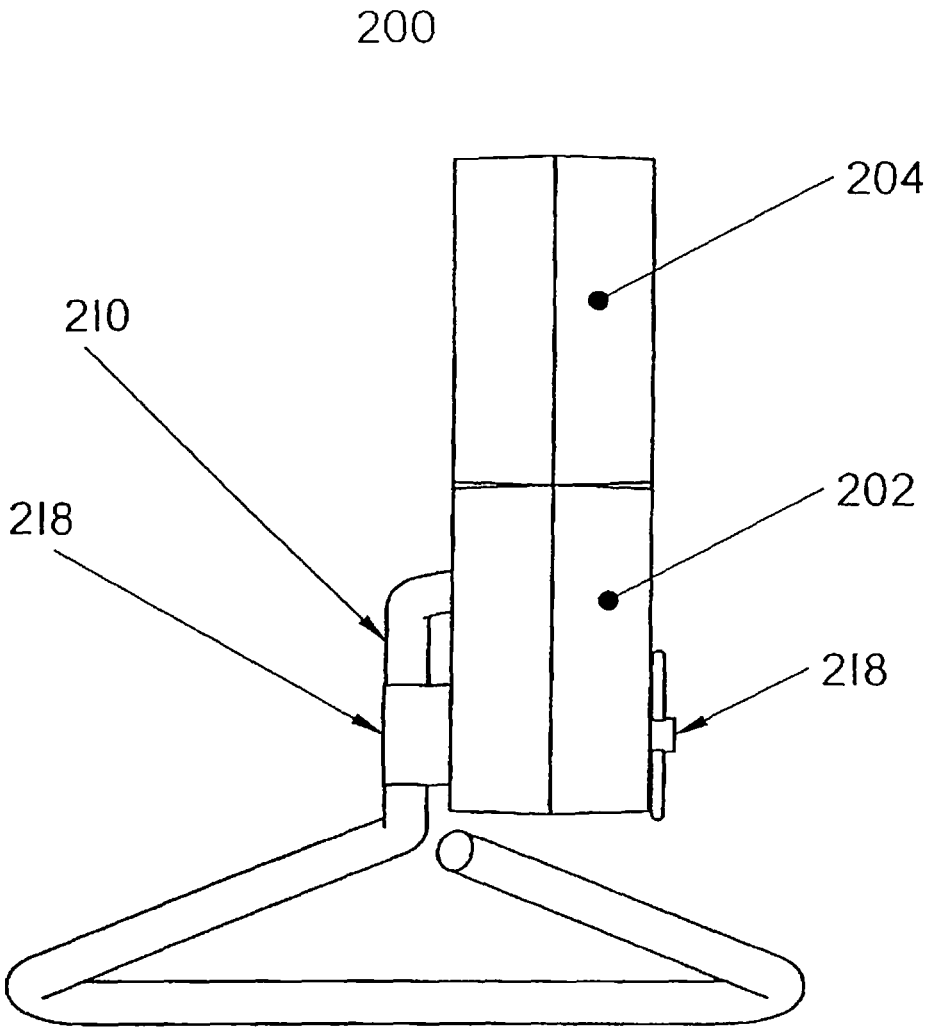
FIG. 19 is an end view of the carrying rack of FIGS. 17-18.
Figure 20:
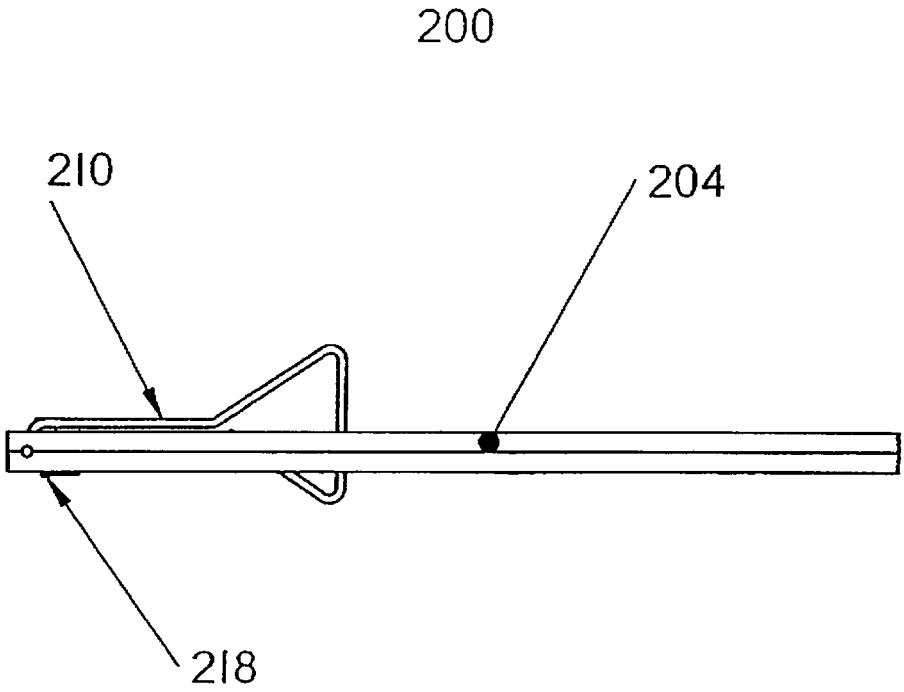
FIG. 20 is a bottom view of the carrying rack of FIGS. 17-19.
Figure 21:
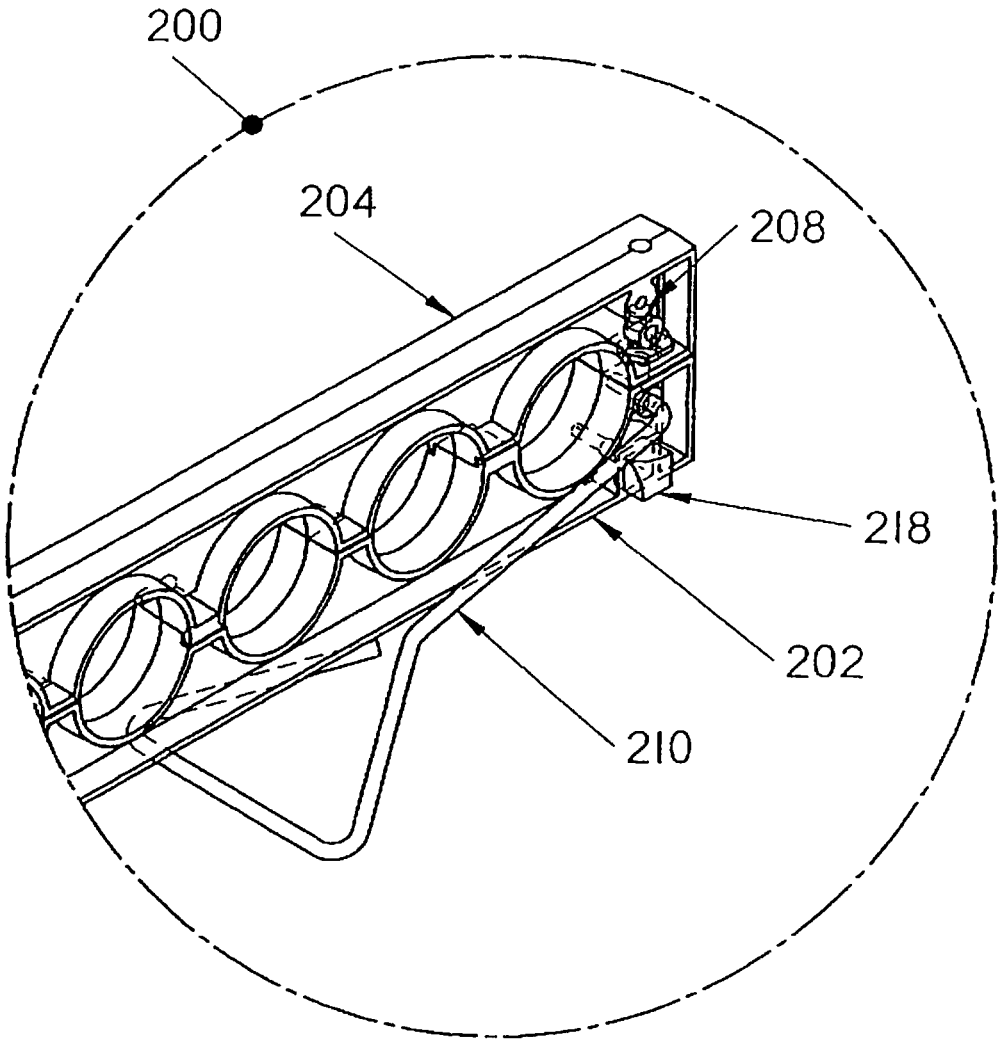
FIG. 21 is an enlarged perspective view of the locking end of the carrying rack of FIGS. 17-20.
Figure 22:
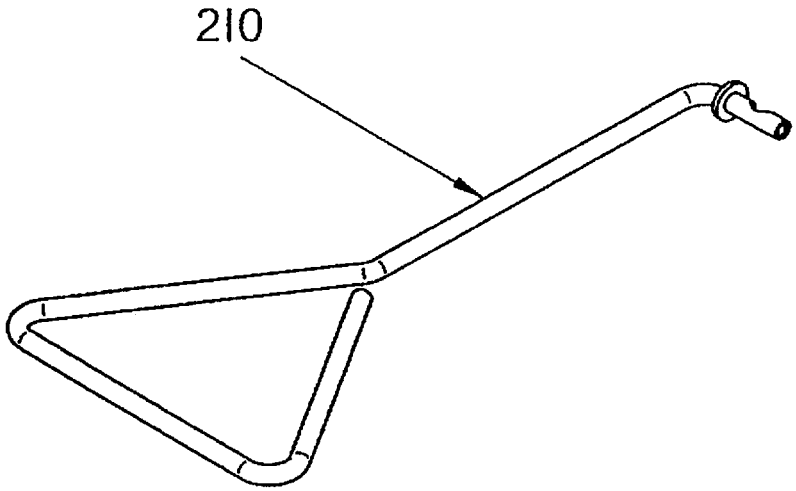
FIG. 22 is an enlarged perspective view of the handle or locking bar of the carrying rack of FIGS. 17-21.
Figure 23:
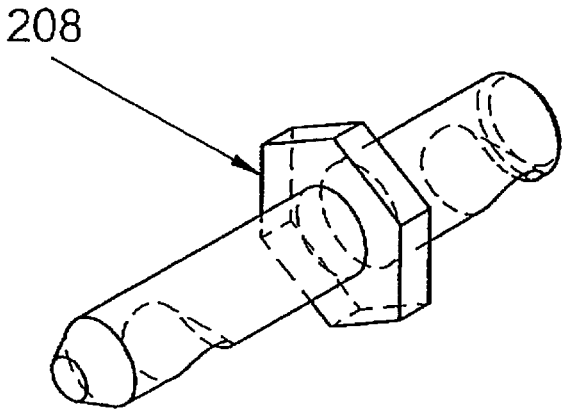
FIG. 23 is an enlarged perspective view of the locking pin of the carrying rack of FIGS. 17-21.
Figure 24:
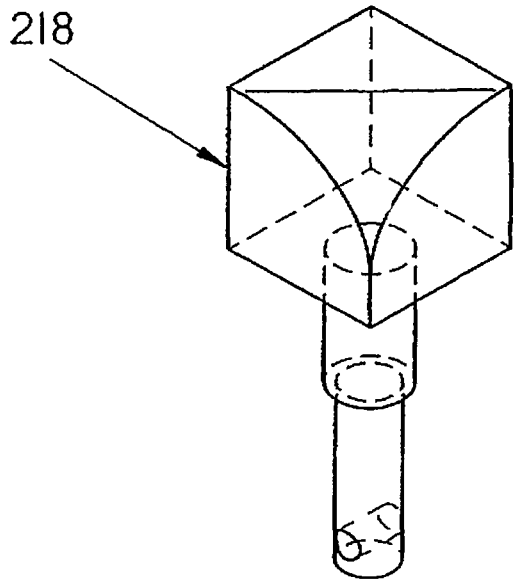
FIG. 24 is an enlarged perspective view of the handle release of the carrying rack of FIGS. 17-21.

Referring now to FIGS. 15 and 16, use of carrying rack 100 with a charged and uncharged hose is provided. Hoses 10, 20 are offered to illustrate the configuration of uncharged or empty hoses 10 and charged or full hoses 20. As seen in FIG. 11, an empty or uncharged hose 11 is supported by carrying rack 100. In an uncharged state, fire hose 12 remains flattened and may be more easily transported. As seen in FIG. 12, a full or charged fire hose 20 is supported by carrying rack 100. Unlike conventional carrying and/or storage devices for supporting a fire hose, fire hose 20 does not need to be removed from carrying rack 100 before charging the line. Fire hoses 10, 20 are shown as individual loops rather than as one continuous hose. The connection and/or nozzle ends of the fire hoses are not shown. Fire hoses 10 or 20 may be completely or selectively removed from carrying rack 100.

Referring now to FIGS. 17-24, another embodiment of the present disclosure is shown generally as hose rack 200. Hose rack 200 is substantially similar to hose rack 100 and will only be described as relates to the differences therebetween. Similar to hose rack 100, hose rack 200 includes first and second base members 202, 204, a handle or locking bar 210 operatively supported in first base member 202, a locking pin 208 supported in first base member 202 and operatively associated with locking bar 210, and a handle release 218 supported in and extending from first base member 202 and operatively associated with locking bar 210 and biased to an extended position.

First and second base members 202, 204 of rack 200 are preferably formed by injection molding. First and second base members 202, 204 include reinforced edges 202a, 204*b*, respectively. Reinforced edges 202*a*, 204*a* extend about the perimeter of members 202, 204 and about openings 205 formed therein. Reinforced edges 202*a*, 204*a* reinforce members 202, 204 and permit the use of less material in forming hose rack 200 while maintaining strength and rigidity thereof. By reducing the amount of material necessary to construct first and second members 202, 204, the overall weight hose rack 200 is also reduced. The use of hardened plastic also increases the durability of first and second members 202, 204.

Thus, it should be understood that various changes in form, detail and operation of the carrying rack of the present disclosure may be made without departing from the spirit and scope of the present disclosure.

What I claim is:

1. A method of supporting a hose comprising the steps of:

providing a carrying rack including:

a first base member;

a second base member securely attachable to the first base member, wherein the first and second base members cooperate to form a plurality of recesses for receiving a hose when the first and second base members are attached to one another;

a break-away hinge having a first hinge member secured to the first base member and a second hinge member secured to the second base member, wherein the first and second hinge members are releasably engageable with one another solely upon a separation of the first base member from the second base member, and wherein the hinge is configured to permit complete separation of the first base member from the second base member upon a pivotable separation of the first base member from the second base member, the first base member being completely separable from the second base member to permit removal of said hose; and a locking mechanism for selectively securing the first base member with respect to the second base member;

placing a hose within the recesses formed within the first base member;

pivoting the second base member, about the break-away hinge, relative to the first base member; and locking the second base member to the first base member such that the hose is retained therein.

2. The method of claim 1, wherein the locking mechanism forms a handle.

3. The method of claim 2, further including the step of supporting the carrying rack by the handle.

* * * * *